US006531962B2

(12) United States Patent
Sudolcan

(10) Patent No.: US 6,531,962 B2
(45) Date of Patent: Mar. 11, 2003

(54) THEFT PREVENTION AND RECOVERY SYSTEM FOR DRINK DISPENSER MACHINES

(75) Inventor: David C. Sudolcan, Atascosa, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 0 days.

(21) Appl. No.: 09/908,411

(22) Filed: Jul. 18, 2001

(65) Prior Publication Data

US 2003/0016132 A1 Jan. 23, 2003

(51) Int. Cl.[7] ..... G08B 13/14
(52) U.S. Cl. ..... 340/571; 340/568.1
(58) Field of Search ..... 340/571, 568.1

(56) References Cited

U.S. PATENT DOCUMENTS 5,091,713 A * 2/1992 Horne et al. ..... 340/568.1
5,130,695 A * 7/1992 Scarbrough et al. . 340/568.1 X
5,207,784 A * 5/1993 Schwartzendruber ..... 221/6
5,406,261 A * 4/1995 Glenn ..... 340/571
5,410,295 A * 4/1995 Van Lint ..... 340/568.1
5,760,690 A * 6/1998 French ..... 340/571
5,809,123 A * 9/1998 Reynolds ..... 340/571 X
5,921,436 A * 7/1999 Lowing ..... 221/279
6,111,504 A * 8/2000 Packard et al. ..... 340/568.1
6,131,399 A * 10/2000 Hall ..... 62/127

* cited by examiner

*Primary Examiner*—Thomas Mullen
(74) *Attorney, Agent, or Firm*—Christopher L. Makay

(57) ABSTRACT

A method and apparatus for theft prevention and/or recovery of stolen drink dispensers generally comprises the provision of an anti-theft device within a drink dispenser machine for detecting illegitimate movements of the machine and thereafter disabling the machine's operation. The disruption of operation is accompanied by an indication on the machine's display panel alerting the possessor of a general failure and requesting the placement of a maintenance service call. Concurrently, an innocuous indicator is also activated for alerting the responding service technician to the possibility that the dispenser machine under repair is stolen.

16 Claims, 1 Drawing Sheet

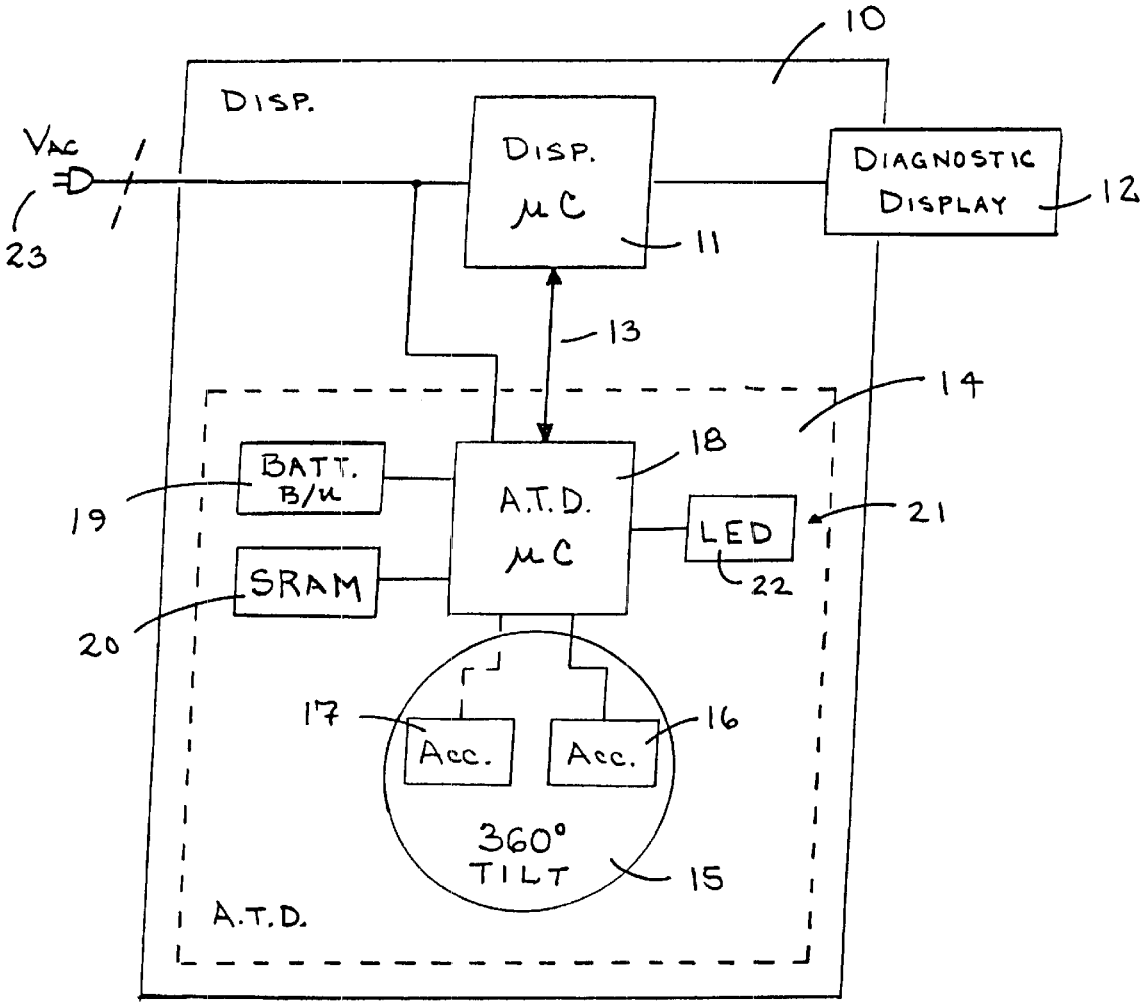
10
DISP.
VAC
23
DISP.
μC
11
DIAGNOSTIC
DISPLAY
12
13
14
BATT.
B/U
19
A.T.D.
μC
18
LED
21
22
SRAM
20
17
Acc.
Acc.
16
360°
TILT
15
A.T.D.

THEFT PREVENTION AND RECOVERY SYSTEM FOR DRINK DISPENSER MACHINES

FIELD OF THE INVENTION

The present invention relates to theft prevention and stolen equipment recovery. More particularly, the invention relates to a method and apparatus for preventing theft of drink dispenser machines and/or facilitating the recovery of stolen drink dispenser machines by disabling operation of illegitimately moved machines while encouraging the possessor thereof to call a central service location.

BACKGROUND OF THE INVENTION

Theft of beverage dispenser machines is estimated to cost the food and beverage service industry millions of dollars per year in equipment replacement and lost resources. Unfortunately, the wide range of equipment placement scenarios and relatively low per machine cost has made the theft problem unusually difficult for the industry to challenge. For example, because beverage dispensers are located in a wide array of store fronts, ranging from large multinational chains to small, family owned neighborhood shops, integration with stored security systems is frustrated by the high cost associated with custom installation. Likewise, the provision of automatic dialers or similar hardware for alerting a central alarm monitoring center requires a dedicated connection to a telephone line that upon legitimate movement of the dispenser must also be moved. Finally, satellite tracking system based approaches, such as implementations utilizing the Global Positioning System (GPS), are generally too expensive to practically integrate into beverage dispensers and, even when not, are easily compromised by the breaking off of antennas or disruption of power. On the other hand, simple reporting of the serial numbers for stolen beverage dispenser machines has proven unreliable due to the service technician's inability to verify every serial number within the time constraints of a routine service call. As a result it has been found that stolen dispenser machines often receive the same service from the service company as a drink dispenser machine in the hands of a rightful owner.

It is therefore a primary object of the present invention to improve over the prior art by providing a theft prevention system particularly adapted for integration within a beverage dispenser machine. It is a further object of the present invention to provide such a system that is inexpensive in implementation, reliable in operation and difficult to thwart. Further, because no prevention scheme can be fail proof and because, even when covered by insurance, replacement costs for stolen equipment generally exceed coverage, it is yet another object of the present invention to provide such a system that also actively contributes to the recovery of stolen beverage machines.

SUMMARY OF THE INVENTION

In accordance with the foregoing objects, the present invention—a method and apparatus for theft prevention and/or recovery of stolen drink dispensers—generally comprises the provision of an anti-theft device within a drink dispenser machine for detecting illegitimate movements of the machine and thereafter disabling the machine's operation. According to the preferred method of the present invention, the disruption of operation is accompanied by the indication on the machine's display panel alerting the possessor of a general failure and requesting the placement of a maintenance service call. Concurrently, an innocuous indicator is also activated for alerting the responding service technician to the possibility that the dispenser machine under repair is stolen. It is predicted that theft of drink dispenser machines incorporating the present invention will be prevented by the general knowledge that a stolen machine will not operate and that, in the case of an unwitting thief, recovery of stolen machines will be enhanced by the covert communication of the stolen status of the machine to responding service technician.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWING

Although the scope of the present invention is much broader than any particular embodiment, a detailed description of the preferred embodiment follows together with an illustrative FIGURE, wherein like reference numerals refer to like components, and wherein:

the FIGURE shows, in schematic block diagram, the anti-theft device of the present invention as integrated within a typical drink dispenser machine.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Referring now to the FIGURE, the present invention is shown to generally comprise an anti-theft device 14 incorporated within a drink dispenser 10. As shown in the FIGURE, the anti-theft device 14 is preferably a separate, self-contained module that can therefore be encased within a protected region of the drink dispenser 10. Those of ordinary skill in the art will recognize, however, that the teachings of the present invention may be fully appreciated in other implementations not comprising this modular structure.

The anti-theft device 14 generally comprises a motion detector 15 and a micro-controller 18. The motion detector 15, as implemented in the preferred embodiment of the present invention, comprises at least one accelerometer 16 for determining pitch and/or roll about two axes. Although those of ordinary skill in the art will recognize that such a single accelerometer embodiment will generally suffice to detect any motion of the drink dispenser 10, it is preferred that a second accelerometer 17 be provided in order that the motion detector 15 may detect movement in any direction. According to the preferred embodiment of the present invention, an Analog Devices device number ADXL202 two-axis acceleration sensor, commercially available form Analog Devices, Inc. of Norwood, Massachusetts, is utilized for each accelerometer 16, 17. Those of ordinary skill in the art, however, will recognize myriad substantially equivalent acceleration sensors and/or other implementations for the motion detector 15.

The anti-theft device micro-controller 18 is electrically connected to the dispenser micro-controller 11 through a serial communication channel 13. In operation, as will be better understood further herein, movement of the drink dispenser 10 is thereby communicated to the dispenser micro-controller 11 for appropriate action. According to the present invention, the anti-theft device micro-controller 18 is programmed to detect any movement of the drink dispenser 10 and, thereafter, to note the same by writing to an appropriate register within provided static random access memory (SRAM) 20. The micro-controller 18 is further programmed to react to movement of the drink dispenser 10 by activation of a theft alert means 21 such as, for example, the illumination of an internally concealed light emitting diode (LED) 22. Although the present invention further comprises a battery backup 19, those of ordinary skill in the art will recognize that utilization of non-volatile memory such as SRAM 20 will serve to enhance reliability of the anti-theft device 14 and prevent thwarting thereof. In the case where the battery 19 is removed or loses charge while the external power 23 is interrupted however, the anti-theft device micro-controller 18 is nonetheless programmed to assume movement, making the same indication as before in the appropriate register of SRAM 20.

The dispenser micro-controller 11 is programmed to disrupt operation of the drink dispenser 10 in the event of an indication in SRAM 20 that the dispenser 10 has been moved. Likewise, the dispenser micro-controller 11 is programmed to disrupt operation of the drink dispenser 10 in the event that the serial communication channel 13 between dispenser micro-controller 11 and the anti-theft device micro-controller 18 is interrupted. Further, the dispenser micro-controller 11 is programmed to indicate a generic error code on the diagnostic display 12 located on the exterior of the drink dispenser 10. Preferably, this error code will alert the operator to telephone a central service location to request maintenance. Upon response, the maintenance technician will then be alerted to the possibility of dispenser theft by the illumination of LED 22 or the removal of the anti-theft device 14. At this point the technician may check the serial number of the drink dispenser 10 against the center's stolen dispenser reports.

Because an illegitimately moved drink dispenser 10 will not function, it is predicted that knowledge of this security feature will greatly diminish the incidence of theft. On the other hand, it is predicted that the disruption of operation coupled with the indication to the service technician of possible theft will greatly enhance recovery of those drink dispensers 10 stolen by unwitting thieves. Finally, however, because operation of the drink dispenser 10 may easily be restored by the true owner through the entry of a dispenser-unique code, legitimate movement of the drink dispenser 10 and/or replacement of the battery 19, even during an external power failure, should not impede rightful operation of the drink dispenser 10 or unnecessarily add to maintenance cost.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. In any case, because the scope of the present invention is much broader than any particular embodiment, the foregoing detailed description should not be construed as a limitation of the scope of the present invention, which is limited only by the claims appended hereto.

What is claimed is:

1. An apparatus for the combat of drink dispenser machine theft, said apparatus comprising:

an anti-theft device adapted to detect illegitimate movement of a drink dispenser machine; and an interface between said anti-theft device and the drink dispenser machine, said interface being adapted to disrupt operation of the drink dispenser machine upon detection of illegitimate movement.

2. The apparatus as recited in claim 1, wherein said anti-theft device comprises a motion detector.

3. The apparatus as recited in claim 2, wherein said motion detector comprises a first accelerometer, said first accelerometer being adapted to detect pitch or roll of the drink dispenser.

4. The apparatus as recited in claim 3, wherein said motion detector further comprises a second accelerometer, said first and said second accelerometers being adapted to detect motion of the drink dispenser in any direction.

5. The apparatus as recited in claim 2, wherein said anti-theft device further comprises a non-volatile memory element, said memory element being adapted to record an illegitimate movement of the drink dispenser.

6. The apparatus as recited in claim 5, wherein said non-volatile memory element comprises static random access memory.

7. The apparatus as recited in claim 2, wherein said anti-theft device further comprises a micro-controller, said micro-controller being adapted to determine the legitimacy of a movement of the drink dispenser.

8. The apparatus as recited in claim 7, wherein said interface comprises a communication channel between said anti-theft device micro-controller and a dispenser micro-controller.

9. The apparatus as recited in claim 8, wherein said communication channel comprises a serial communication line.

10. The apparatus as recited in claim 8, wherein said dispenser micro-controller is adapted to disrupt operation of the drink dispenser upon receipt of a message through said communication channel indicative of an illegitimate movement of the drink dispenser.

11. The apparatus as recited in claim 10, wherein said dispenser micro-controller is further adapted to display a service required message upon receipt of a message through said communication channel indicative of an illegitimate movement of the drink dispenser.

12. The apparatus as recited in claim 8, wherein said dispenser micro-controller is adapted to disrupt operation of the drink dispenser upon severance of said communication channel.

13. The apparatus as recited in claim 8, wherein said dispenser micro-controller is adapted to disrupt operation of the drink dispenser upon any total interruption of electrical power to said anti-theft device.

14. The apparatus as recited in claim 13, wherein said anti-theft device further comprises a battery backup system.

15. The apparatus as recited in claim 8, wherein said anti-theft device further comprises a covert indicator, said covert indicator being adapted to innocuously indicate illegitimate movement of the drink dispenser.

16. The apparatus as recited in claim 15, wherein said covert indicator comprises a light emitting diode (LED), said LED being disposed within an internal region of the drink dispenser.

* * * * *